US009865417B2

(12) United States Patent
Zehnder et al.

(10) Patent No.: US 9,865,417 B2
(45) Date of Patent: Jan. 9, 2018

(54) CIRCUIT BREAKER

(71) Applicant: ABB Technology AG, Zürich (CH)

(72) Inventors: Lukas Zehnder, Baden-Dättwil (CH); Erwin Manz, Lauchringen (DE)

(73) Assignee: ABB Schweiz AG, Baden (CH)

( * ) Notice: Subject to any disclaimer, the term of this patent is extended or adjusted under 35 U.S.C. 154(b) by 0 days.

(21) Appl. No.: 14/908,714

(22) PCT Filed: Jul. 24, 2014

(86) PCT No.: PCT/EP2014/065897
§ 371 (c)(1),
(2) Date: Jan. 29, 2016

(87) PCT Pub. No.: WO2015/014703
PCT Pub. Date: Feb. 5, 2015

(65) Prior Publication Data

US 2016/0172133 A1 Jun. 16, 2016

(30) Foreign Application Priority Data

Jul. 30, 2013 (DE) ..... 10 2013 108 154

(51) Int. Cl.
*H01H 33/82* (2006.01)
*H01H 33/74* (2006.01)
(Continued)

(52) U.S. Cl.
CPC ..... *H01H 33/82* (2013.01); *H01H 33/56* (2013.01); *H01H 33/74* (2013.01); *H01H 33/91* (2013.01);
(Continued)

(58) Field of Classification Search
CPC .... H01H 1/385; H01H 1/62; H01H 2009/526; H01H 33/02; H01H 37/761
See application file for complete search history.

(56) References Cited

U.S. PATENT DOCUMENTS 4,562,322 A * 12/1985 Yamaguchi ..... H01H 33/021 174/110 N
6,163,001 A * 12/2000 Zehnder ..... H01H 33/98 218/11
(Continued)

FOREIGN PATENT DOCUMENTS

CH 534421 A 2/1973
CN 1072536 A 5/1993
(Continued)

OTHER PUBLICATIONS

International Search Report and Written Opinion for PCT/EP2014/065897, dated Oct. 10, 2015, 14 pages, English Translation Provided.

*Primary Examiner* — Truc Nguyen
(74) *Attorney, Agent, or Firm* — Taft Stettinius & Hollister LLP

(57) ABSTRACT

The invention relates to a circuit breaker that can be switched between an ON position and an OFF position, such that in the OFF position an interruption path comprising an arcing space is formed. The circuit breaker comprises a storage volume for a quenching gas, which is in gaseous communication with the arcing space and has an inlet port for the quenching gas. The inlet port also has a valve comprising an obturator, and the obturator has a heat-insulating coating.

23 Claims, 3 Drawing Sheets

(51) Int. Cl.
*H01H 33/91* (2006.01)
*H01H 33/56* (2006.01)
*H01H 33/90* (2006.01)

(52) U.S. Cl.
CPC . *H01H 2033/906* (2013.01); *H01H 2033/908* (2013.01); *H01H 2239/072* (2013.01)

(56) References Cited

U.S. PATENT DOCUMENTS

| | | | | |
|---|---|---|---|---|
| 7,758,968 | B2 | 7/2010 | Schmitz et al. | |
| 2008/0006609 | A1* | 1/2008 | Schoenemann | H01H 33/74 218/157 |
| 2009/0261071 | A1* | 10/2009 | Nufer | H01H 33/901 218/81 |
| 2010/0326958 | A1 | 12/2010 | Gregoire et al. | |
| 2011/0062116 | A1* | 3/2011 | Kriegel | H01H 33/901 218/43 |
| 2011/0120975 | A1* | 5/2011 | Nufer | H01H 33/901 218/63 |
| 2011/0259852 | A1* | 10/2011 | Rival | H01H 9/342 218/150 |
| 2013/0056444 | A1* | 3/2013 | Cernat | H01H 33/91 218/51 |
| 2013/0284703 | A1* | 10/2013 | Yoshitomo | H01H 33/91 218/84 |
| 2014/0346143 | A1* | 11/2014 | Miyamoto | C09D 163/00 218/1 |

FOREIGN PATENT DOCUMENTS

| | | | |
|---|---|---|---|
| CN | 1283744 | A | 2/2001 |
| CN | 1890456 | A | 1/2007 |
| CN | 201818472 | U | 5/2011 |
| DE | 29604500 | U1 | 6/1996 |
| EP | 0543334 | A2 | 5/1993 |
| EP | 0696040 | B1 | 6/1998 |
| EP | 1074737 | A2 | 2/2001 |
| EP | 0951039 | B1 | 6/2003 |
| JP | 2000164085 | A | 6/2000 |
| SU | 1265471 | A1 | 10/1986 |
| WO | 2015014703 | A1 | 2/2015 |

* cited by examiner

CIRCUIT BREAKER

TECHNICAL FIELD

The invention relates to the field of electrical energy generation and transmission. It relates to a circuit breaker as claimed in the introductory clause of the independent patent claim, which is specifically designed for use in power plants, transformer substations and other electricity supply facilities for the switching-in and switching-out of service currents and overcurrents, specifically in the medium- and high-voltage range.

TECHNOLOGICAL BACKGROUND

A switch of this type is known, for example, from European patent applications EP 0696040 A1 and EP 0951039 A1, the contents and disclosure of which are fully incorporated in the scope of the present patent application, by way of reference thereto.

During the switching of high currents by switches of this type, specifically in the event of a short-circuit, high pressures in the range of 10 to 100 bar and temperatures in excess of 2300° K. typically occur in the insulating gas contained in a pressure chamber and in a return duct. In the case of very high currents, specifically in a range in excess of 250 kA and/or in switches of compact construction, temperatures of up to 3000° K. or higher may occur. As a result, the obturator of a non-return valve, configured as a metal ring, which is fitted to the outlet of the return duct to the heating chamber for the insulating gas may undergo plastic strain, such that the non-return valve is no longer capable of satisfactorily fulfilling its function.

Tests have demonstrated that plastic strain of this type can be prevented, or at least substantially reduced, by the use of an obturator of more solid construction; however, this is associated with a simultaneous increase in the inertia of the non-return valve such that, upon actuation, the closure of the return duct by raid valve is insufficiently rapid, thereby permitting the unwanted escape of insulating gas from the heating chamber.

A puffer-type circuit breaker is known from DE 29604500 U1, in which the puffer piston is coated with a layer of heat-resistant plastic, such as PTFE or polyamide, in order to provide electrical shielding in relation to the contact piece or to prevent the formation of root points for the switching arc on the puffer piston.

Accordingly, the object of the invention, is the proposal of a circuit breaker which eliminates the disadvantages described above.

DESCRIPTION OF THE INVENTION

The above-mentioned and other objects are fulfilled by a circuit breaker with the characteristics described in the independent patent claim. Further advantageous embodiments of the invention are described in the dependent patent claims.

A circuit breaker according to the invention, which can be switched between a ranking position and a breaking position such that, in the breaking position, an interruption path is formed, comprising an arcing space; the circuit breaker comprises a storage volume for a quenching gas which Is in gaseous communication with the arcing space, wherein said storage volume is provided with an inlet for the quenching gas, and wherein said inlet is also fitted with a valve comprising an obturator, by means of which the inlet may be closed. The obturator is provided with a heat-insulating coating. The heat-insulating coating prevents the plastic strain of the obturator.

In an alternative configuration of the circuit breaker according to the invention, which can be switched between a making position and a breaking position, comprising a first power terminal and a second power terminal and wherein, in the making position, an electrically-conductive connection is formed between the first power terminal and the second power terminal and, in the breaking position, an interruption path is formed between the first power terminal and the second power terminal, wherein said interruption path comprises an arcing space which is formed, between a first contact element, which is in electrically-conductive contact with the first power terminal, and a second contact element, which is in electrically conductive contact with the second power terminal, a storage volume for a quenching gas which is in gaseous communication with the arcing space, wherein said storage volume is provided with an inlet for the quenching gas, and wherein said inlet is fitted with a valve comprising an obturator, by means of which the inlet may be closed, the obturator is provided with a heat-insulating coating. Here again, the heat-insulating coating prevents the plastic strain of the obturator.

In a preferred further development of the circuit breaker according to the invention, the heat-insulating coating is comprised of a plastic, preferably a polymer. For this purpose, a thermosetting plastic is specifically preferred, as this remains rigid up to its breakdown temperature, thereby specifically preventing the formation of drips. In some instances, drips of this type occur in elastomers, and specifically in thermoplastic polymers, frequently resulting in flaming at temperatures within or in excess of the breakdown temperature range of the corresponding plastic, specifically by the ignition of the drips or droplets thus formed. The use of a plastic comprised of an epoxy resin or an epoxy resin system is specifically preferred.

In another preferred further development of the circuit breaker according to the invention, the heat-insulating coating is comprised of a plastic, specifically an epoxy resin or an epoxy resin system, incorporating one or more filler materials which, specifically, show an at least substantially even distribution throughout the volume of plastic. Specifically, ceramic powders, for example aluminum oxide, may be used as a filler material; however, good results have also been achieved in tests using molybdenum sulfide in powdered form. The filler material enhances the fire resistance of the plastic, and improves the mechanical stability of both the heat-insulating coating and of the coated obturator as a whole.

In another preferred further development of the circuit breaker according to the invention, the material selected for the heat-insulating coating—specifically a plastic of the type described above—shows low thermal conductivity $\lambda$ of $\lambda<10$ W/(mK), wherein $\lambda\leq1.0$ W/(mK) is preferred, and $\lambda\leq0.3$ W/(mK) is specifically preferred. This permits the achievement of sufficient thermal insulation, even in the case of a relatively thin coating with a thickness of the order of several tens of μm.

In another preferred further development of the circuit breaker according to the invention, the material selected for the heat-insulating coating—specifically a plastic of the type described above—shows an elastic modulus E of $E\geq5$ GN/m$^2$, wherein $E\geq10$ GN/m$^2$ is preferred and $E\geq20$ GN/m$^2$ is specifically preferred. Specifically in combination with an obturator comprised of a metal with a relatively low elastic modulus, specifically including aluminum, magnesium, etc., in combination with a solid and irreversible material bond of the type formed between the obturator and the heat-insulating coating, this results in increased rigidity, specifically in annular obturators, thereby reducing plastic strain in the obturator associated with the breaking process.

In another preferred, further development of the circuit breaker according to the invention, the selected material for the heat-insulating coating—specifically a plastic of the type described above—shows a longitudinal coefficient of thermal expansion $\alpha$ of $\alpha \geq 20.10^{-6}$/K, wherein $\alpha \leq 15.10^{-6}$/K is preferred and $\alpha \leq 10.10^{-6}$/K is specifically preferred. Specifically in combination with an obturator comprised of a metal with a relatively high longitudinal coefficient of thermal expansion, specifically including aluminum, beryllium, magnesium, etc., in combination with a solid and irreversible material bond of the type formed between the obturator and the heat-insulating coating, this results in the reduction of plastic strain in the obturator associated with the breaking process.

In another preferred further development of the circuit breaker according to the invention, the selected material for the heat-insulating coating is a plastic which shows a glass transition temperature $T_G$ of $T_G \geq 293°$ K., wherein $T_G \geq 323°$ K. is preferred and $T_G \geq 373°$ K. is specifically preferred. The selection of a plastic with a high glass transition temperature ensures exceptionally high robustness at high temperatures. thereby permitting a particularly effective reduction of plastic strain in the obturator associated with the breaking process.

In another preferred further development of the circuit breaker according to the invention, the material used for the heat-insulting coating is a ceramic material or a perfluorocarbon, specifically polytetrafluoroethylene (PTFE).

BRIEF DESCRIPTION OF FIGURES

In the Figures.

In principle, the same reference numbers designate the same components.

MEANS OF EMBODIMENT OF THE INVENTION

Figure 1:
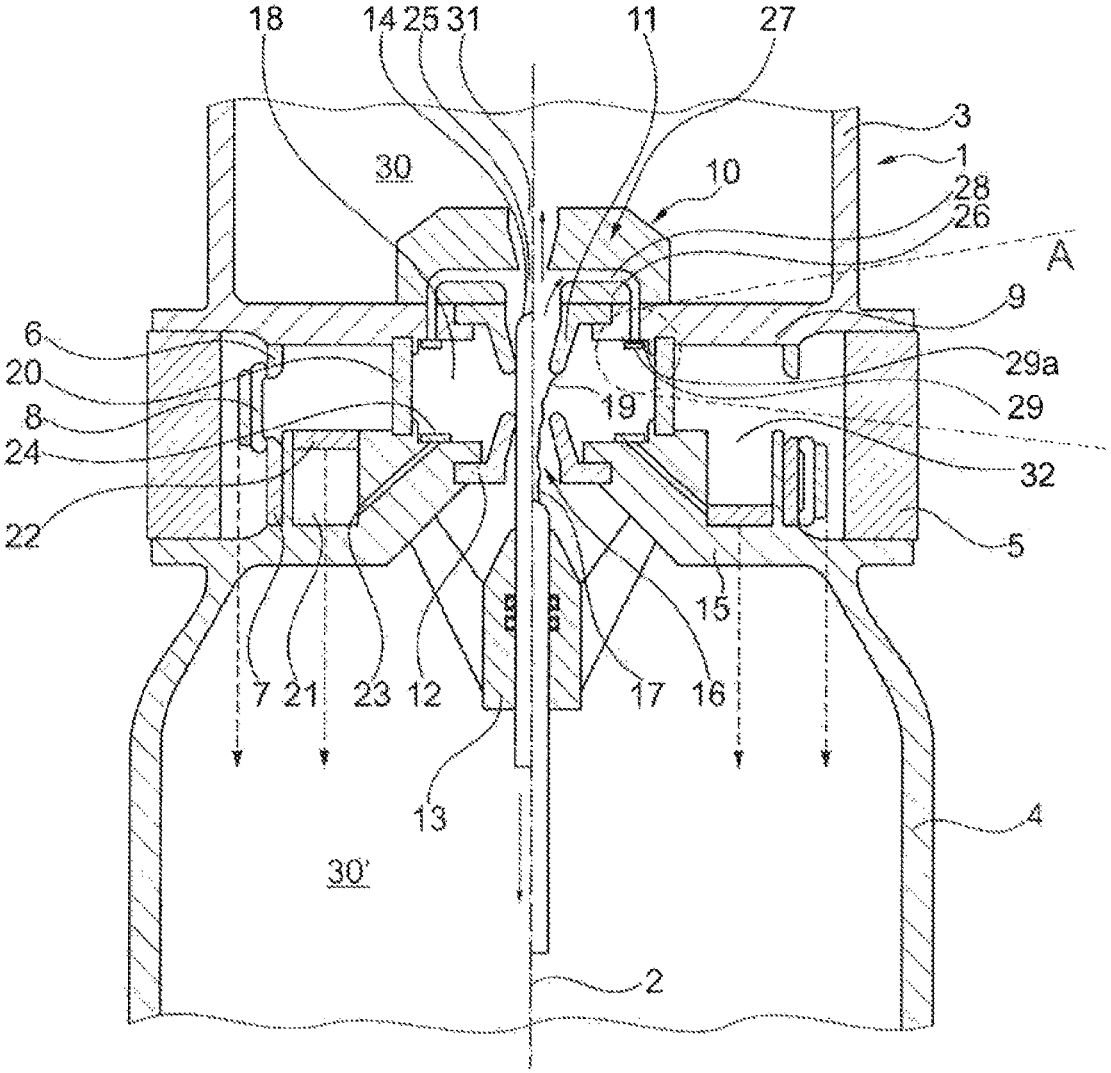
FIG. 1 shows a partial axial longitudinal section of a circuit breaker according to the invention.

FIG. 1 shows a partial axial longitudinal section of a circuit breaker according to the invention, specifically a generator circuit breaker, represented in the making position on the left-hand side and in the breaking position on the right-hand side. The circuit breaker is provided with a housing 1, configured in an at least essentially rotationally symmetrical arrangement around an axially-oriented switching axis 2. The housing 1 comprises an upper housing element 3 and a lower housing element 4, both of metal, which are connected by a cylindrical central housing element 5 of insulating material. The upper housing element 3 and the lower housing element 4 are connected to a first power terminal and a second power terminal, respectively, of the circuit breaker. The entire housing 1 is filled with an insulating gas, preferably $SF_6$, which serves as a quenching gas.

At the level of the central housing element 5, a rated current path is configured on the outside, comprised of axially-spaced, circumferential and fixed rated current contacts—an upper fixed rated current contact 6 and a lower fixed rated current contact 7—connected to the upper housing element 3 and the lower housing element 4 respectively, and a moveable rated current contact 8, with a sequential series of circumferential contact fingers which bridge the gap between the fixed rated current contacts 6, 7. The moveable rated current contact 8 is connected to a switching mechanism, which is not represented, by means of which it is displaceable in an axial direction between a making position of the circuit breaker, in which it bridges the clearance between, the upper fixed rated current contact 6 and the lower fixed rated current contact 7, and a breaking position of the circuit breaker, in which it forms a gap to the upper fixed rated current contact 6.

The upper housing element 3 is closed at its lower end by a first horizontal partition 9. The latter carries a fixed element of an arcing contact arrangement 10. A central opening in the first partition 9 carries a first contact element in the form of a tulip contact 11, which is provided with a sequential series of circumferential elastic contact fingers, oriented obliquely downwards and against the switching axis 2 and separated by slots. Opposite the tulip contact 11 and encompassing the switching axis 2, a nozzle 12 of an electrically insulating material is arranged, configured in the form of a cone which narrows towards its upper end. A sliding bush 13 fitted to the lower housing element 4, which also provides a good electrically-conductive bond, carries a second contact element in the form of a contact rod 14, which is axially displaceable by the switching mechanism and which, in the making position of the circuit breaker, projects into the tulip contact 11 and is contacted on its exterior by the contact fingers thereof. As a result, the latter undergo elastic strain, such that they apply a relatively high contact pressure to the contact rod 14. The sliding bush 13 is secured to a second partition 15, which closes the lower housing element 4 at its upper end. The nozzle 12 is secured in a central opening in the second partition 15.

In the breaking position of the circuit breaker, the contact rod 14 is pulled downwards, such that the tip thereof lies below the nozzle 12. An arcing space 16 is then formed between the tulip contact 11 and the contact rod 14. If, at the start of the switchover process, in which the circuit breaker switches from the making position to the breaking position, a sufficiently high current is flowing between the first and the second power terminals, an arc 17 will be generated in the arcing space 16 between the above-mentioned contact elements at the end of the switchover process. The arcing space 16 is surrounded by a continuous and annular storage volume, which serves as a heating chamber 18. The heating chamber 18 is connected to the arcing space 16 by a gap which separates the tulip contact 11 from the nozzle 12, thereby forming a circumferential puffer slot 19. The puffer slot 19 accordingly forms an opening, and serves as a puffer opening which is oriented in opposition to the arcing space 16. On its exterior, the heating chamber 18 is enclosed by a circumferential third partition 20 of heat-insulating material, which serves as an insulator for the heating chamber.

At its upper end, the arcing space 16 communicates with a pressure chamber 25, being separated therefrom by an opening formed by the ends of the contact fingers of the tulip contact 11, which pressure chamber is enclosed by the upwardly-extending tulip contact 11, a contiguous annular cover 26 of electrically-insulating material construction and a steel cap 27, whereby the latter surrounds the cover 26 with an intervening clearance and, to the exterior thereof, engages with the first partition 9. The cover 26 and the cap 27, arranged with a clearance to the latter, enclose a return duct 28 which is rotationally symmetrical around the switching axis 2 and which, in a first area of the pressure chamber 25, is routed radially outwards on all sides and, in a second area, turns downwards and is routed in an axial direction to the heating chamber 18. Accordingly, the effective cross-section of the return duct 28 extends continuously in the first area in an outward direction from the switching axis. An opening from the return duct 28 into the heating chamber 18 forms an inlet for the insulating gas. The opening is fitted with a first non-return valve, which is provided with a first obturator, configured as a circumferential and rigid first metal ring 29, preferably of spring steel. A reverse side of the first metal ring 29, facing the return duct 28, is provided with a heat-insulating coating 29*a* of epoxy resin. As an exhaust, by means of which the pressure chamber 25 communicates with the interior of the upper housing element 3, which serves as an exhaust chamber 30, the cap 27 is provided with a central exhaust opening 31. At its lower end, the arcing space 16 communicates with a further exhaust chamber 30' in the lower housing element 4.

The second partition 15 is provided with a plurality e.g. four puffer cylinders 21 distributed over the circumference thereof, with puffer pistons 22 actuated by the switching mechanism, which are connected respectively to the heaping chamber 18 by means of puffer ducts 23. At the openings of the puffer ducts 23 into the heating chamber 18, a second non-return valve is fitted, which is provided with a second obturator, configured as a circumferential and rigid second metal ring 24.

In detail, a breaking operation proceeds as follows:

Starting from the making position represented on the left-hand side of the diagram, the switching mechanism, which is not represented, moves the moveable rated current contact 8, the contact rod 14 and the puffer pistons 22 downwards. Shortly after the start of this movement, the moveable rated current contact 8 separates from the upper fixed rated current contact 6, such that the rated current path is interrupted and the current is switched to the arcing contact arrangement 10. A little later, the contact rod 14 is withdrawn from the tulip contact 11. A arc 17 is generated between these contact elements which, upon the completion of the switching motion, extends through the arcing space 16 which is formed by the movement of the contact rod 14 over the breaker gap. In the heating chamber 18, a pressure increase is generated by the movement of the puffer pistons 22, which causes an insulating gas stream to be propelled from the puffer pistons 21 via the puffer ducts 23 into the heating chamber 18. If, as a result of other effects, a pressure build-up of insulating gas in the heating chamber 18 exceeds the puffer pressure, a second non-return valve 24 closes, thereby preventing the escape of gas from the heating chamber 18 into the puffer duets 23.

By means of the heat energy radiated from the are 17 through the puffer slot 19 into the heating chamber 18, the insulating gas in the latter is strongly heated, such, that the pressure in the heating chamber 18 undergoes a further substantial increase.

A further and highly significant contribution to the pressure build-up in the heating chamber 13 is delivered by the pinch-effect pressure of the arc 17, which is generated by the rapid constriction thereof in the vicinity of the switching axis 2, and causes a strong short-term axial flow from the arcing space 16 to the pressure chamber 25, and an associated strong increase in pressure in the latter. This pressure is partially discharged via the return duct 28 into the heating chamber 18. To this end, it is favorable that the flow resistance in the return duct 28 is very low, due to the extended cross-section of the latter, the direct routing thereof, and the configuration thereof without built-in components. The first non-return valve on the opening of the return duct 28 into the heating chamber 18 prevents the escape of gas from the heating chamber 18 when the pressure therein exceeds that in the pressure chamber 25, which generally declines relatively quickly.

In the case of very high flow volumes, the pinch-effect pressure generated is so high that a complete routing of gas into the heating chamber would result in the mechanical and thermal overloading of the arcing contact arrangement 10. Accordingly, any surplus pressure is discharged directly into the exhaust chamber 30 via the exhaust opening 31. The central arrangement of the exhaust opening 31 is therefore advantageous, in that an excess pinch-effect pressure primarily generates a pressure surge in an axial direction, which pressure surge can be released via the exhaust opening 31 with no resulting damage. In order to reduce the flow-dependency of the pressure build-up in the pressure chamber 25, a pressure-relief valve may preferably be fitted to the exhaust opening. Once a high pressure has built up in the heating chamber 18, the arc 17 is extinguished at the next zero-crossing, whereby the insulating gas, in part, flows out of the heating chamber 18 through the puffer slot 19 and the tulip contact 11 into the pressure chamber 25, in which the pressure has already dropped substantially at this point in time, and thereafter flows through the exhaust opening 31 into the exhaust chamber 30. Accordingly, the puffer slot 19 serves as an outlet for the insulating gas from the heating chamber 18 to the arcing space 16. In its outward flow, the stream of insulating gas inevitably intersects with the arc path and, in the zone of intersection, substantially displaces all ionized gases such that, after the zero-crossing, no further arc can be generated. The remaining part of the insulating gas flows parallel to the arc path 16 through the nozzle 12 into the further exhaust chamber 30'.

Figure 2:
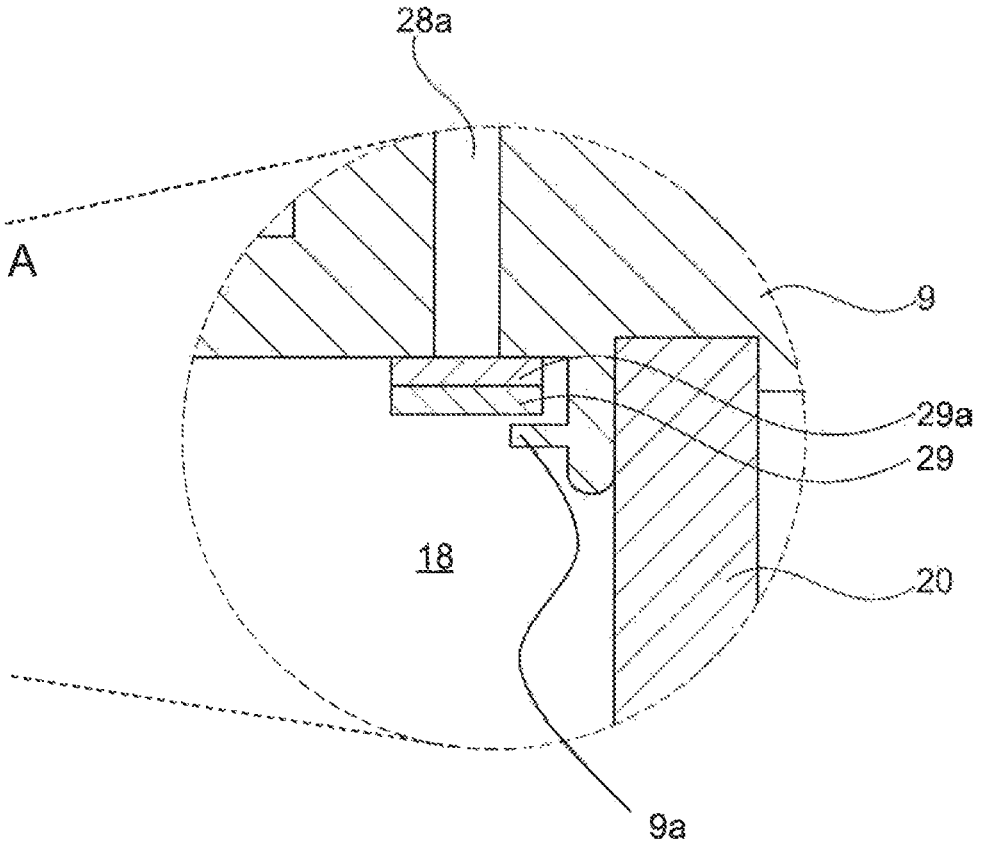
FIG. 2 shows a partial enlargement, corresponding to area A in FIG. 1, of a circuit breaker according to the invention.

FIG. 2 shows a schematic representation of a partial enlargement of area A in FIG. 1, in which the epoxy resin heat-insulating coating 29*a* applied to the reverse side of the first metal ring 29 facing the return duct 28 is shown in detail.

The preferred thickness of the heat-insulating coating 23*a* is preferably smaller than the cross-section of the metal ring 29, and is defined as the square root of the cross-sectional surface area of the metal ring 29, preferably smaller than the minimum longitudinal expansion of the metal ring 29 in cross-section.

The first metal ring 29 is maintained in position by an at least partially circumferentially configured projection 9*a*, which is arranged, on a protuberance 9*b* provided on the first partition 9, opposite the opening of the return duct 28 leading to the heating chamber 18. Preferably, one or more springs, not represented in FIG. 2, specifically spiral or leaf springs, may be provided between the first metal ring 29 and the projection 9*a*, in order to compress or pre-tension the first metal ring 29 against the opening.

Although the breakdown temperature of epoxy resin, depending upon its exact composition, lies within the range of 200-400° C., and is therefore substantially lower than the maximum temperature $T_{max}$ of the insulating gas in the return duct 28, such that $T_{max} \geq 2300°$ K., tests have shown, surprisingly, that the coating 29*a* can effectively reduce or even entirely prevent the strain, observed in the obturator of known circuit breakers, such that the backflow of insulating gas from the heating chamber 18 to the return duct 28, even after a plurality of breaking operations, is effectively prevented. This is partially attributable to the fact that, in the light of the low thermal conductivity λ of the epoxy resin, within the range of $0.1 \leq \lambda \cdot mk/W \leq 0.5$, the heat-up of the metal ring 29 is prevented, or is at least substantially reduced. Secondly, mechanical stabilization of the first metal ring 29 is achieved as a result of the high elastic modulus E of the epoxy resin, within the range of $15\ GN/m^2 \geq E \geq 20\ GN/m^2$.

As experiments have surprisingly demonstrated, although the coating 29*a* is associated with a slightly inferior seal on the first non-return valve, this has no influence upon the breaking performance of the circuit breaker, as determined in the context of customary measurements and investigations.

It has also been, shown, that the application of a heat-insulating coating to the second metal ring 24 on the second non-return valve can be omitted on the grounds that, in the zone of the second non-return valve, significantly lower pressures and temperatures occur in the quenching gas than in the zone of the first non-return valve. As also described above, only cold quenching gas at a relatively low pressure, preferably in the range of 1-10 bar, is compressed through the second non-return valve by means of the puffer cylinders 21 via the puffer ducts 23 into the heating chamber 18. A further and substantial increase in the pressure of the quenching gas, preferably to values in the range of 10-100 bar, is only achieved by the direct heating effect of the arc and the additional return of quenching gas via the return duct 28 into the heating chamber 18.

Figure 3:
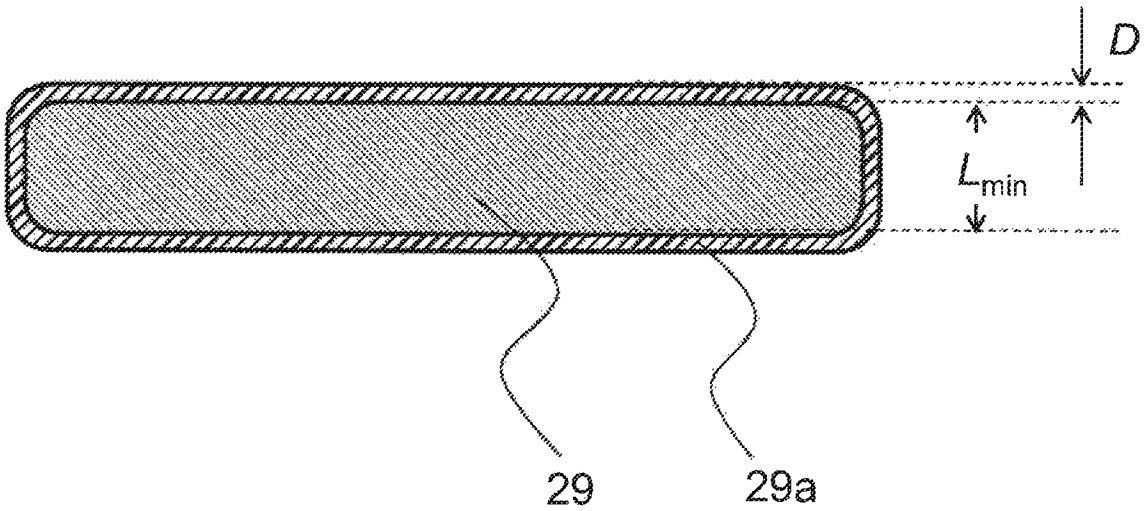
FIG. 3 shows a cross-section of the first obturator of a circuit breaker according to a further preferred example of embodiment of the present invention.

FIG. 3 shows a schematic representation of a cross-section of a first obturator for a circuit breaker according to a further preferred example of embodiment of the present invention. The epoxy resin heat-insulating coating 29*a* is applied such that it entirely encloses the metal ring 29. This permits, firstly, a simpler and more cost-effective manufacturing process; secondly, it permits a further reduction in strain. Here again, the preferred thickness D of the heat-insulating coating 29*a* is preferably smaller than, the cross-section Q of the metal ring 29, which cross-section is defined as the square root of the cross-sectional surface area A of the metal ring 29, i.e. $Q=\sqrt{A}$; preferably smaller than the minimum longitudinal expansion $L_{min}$ of the metal ring 29 in cross-section.

As experiments have also surprisingly demonstrated, where epoxy resin is: used, values of preferably $D<Q/2$ and/or $D<L_{min}/2$, most preferably even values of $D<Q/10$ and/or $D<L_{min}/10$ will suffice for the thickness D of the heat-insulating coating 29*a*. The thickness D of the heat-insulating coating 29*a* preferably lies in the range of $0.01\ mm \leq D \leq 1.0\ mm$, preferably $0.05\ mm \leq D \leq 0.5\ mm$, and most preferably $0.08\ mm \leq D \leq 0.2\ mm$. The minimum longitudinal expansion $L_{min}$ and/or cross-section Q preferably lie within the range of 0.5 mm and 20.0 mm, and most preferably between 1.0 mm and 5.0 mm.

Although the invention has heretofore been described and illustrated with reference to specific forms of embodiment, said invention is not restricted to these forms of embodiment. Within the scope of protection and equivalence of the patent claims, various modifications of details might be applied, with no resulting deviation from the invention.

LIST OF REFERENCE SIGNS

1 Housing
2 Switching axis
3 Upper housing: element
4 Lower housing element
5 Central housing element
6 Upper fixed rated current contact
7 Lower fixed rated current contact
8 Moveable rated current contact
9 First partition
9*a* Projection
10 Arcing contact arrangement
11 Tulip contact
12 Nozzle
13 Sliding bush
14 Contact rod
15 Second partition
16 Arcing space
17 Arc
18 Heating chamber
19 Puffer slot
20 Third partition
21 Puffer cylinder
22 Puffer piston
23 Puffer duct
24 Non-return valve
25 Pressure chamber
26 Cover
27 Cap
28 Return duct
29 Metal ring
29*a* Heat-insulating coating
30 Exhaust chamber
30' Further exhaust chamber
31 Exhaust opening
32 External extinction chamber

The invention claimed is:

1. A circuit breaker, which can be switched between a making position and a breaking position such that, in the breaking position, an interruption path is formed, comprising an arcing space; wherein the circuit breaker comprises:

a storage volume for a quenching gas which is in gaseous communication with the arcing space, wherein said storage volume is provided with an inlet for the quenching gas, and wherein said inlet is also fitted with a valve comprising an obturator; and wherein said obturator is provided with a heat-insulating coating for the prevention of plastic strain.

2. The circuit breaker as claimed in claim 1, wherein the heat-insulating coating is formed of a thermosetting plastic.

3. The circuit breaker as claimed in claim 1, wherein the heat-insulating coating is formed of a plastic material having an elastic modulus E of $E \geq 5\ GN/m^2$.

4. The circuit breaker as claimed in claim 3, wherein the heat-insulating coating is formed of a plastic material having an elastic modulus E of $E \geq 20\ GN/m^2$.

5. The circuit breaker as claimed in claim 1, wherein the heat-insulating coating is formed of a material having a longitudinal coefficient of thermal expansion α of $\alpha \leq 20 \cdot 10^{-6}/K$.

6. The circuit breaker as claimed in claim 5, wherein the heat-insulating coating material is a plastic material having a longitudinal coefficient of thermal expansion α of $\alpha \leq 10 \cdot 10^{-6}/K$.

7. The circuit breaker as claimed in claim 1, wherein the heat-insulating coating is formed of epoxy resin.

8. The circuit breaker as claimed in claim 1, wherein the heat-insulating coating is formed of a ceramic material.

9. The circuit breaker as claimed in claim 1, wherein a permanent and irreversible material bond is formed between the obturator and the heat-insulating coating.

10. The circuit breaker as claimed in claim 1, wherein the arcing space is formed between a first contact element and a second contact element, wherein the quenching gas which is heated by an arc generated between the contact elements during a breaking operation can be routed from the arcing space via the inlet to the storage volume.

11. The circuit breaker as claimed in claim 1, wherein the heat-insulating coating is applied to a surface of the obturator which, in the closed position thereof, faces away from the storage volume.

12. The circuit breaker as claimed in claim 1, wherein the storage volume is configured as a heating chamber, in which the quenching gas can be heated by the heat energy radiated by an arc which is generated by a breaking operation.

13. The circuit breaker as claimed in claim 1, wherein the obturator is formed of an aluminum or steel metal.

14. The circuit breaker as claimed in claim 1, wherein the storage volume, for the exchange of gas with the arcing space, is provided with an outlet for the quenching gas which is oriented in opposition to the arcing space.

15. The circuit breaker as claimed in claim 14, wherein said outlet for the quenching gas is configured as a puffer opening.

16. The circuit breaker as claimed in claim 1, wherein the circuit breaker comprises a pressure chamber which communicates with the arcing space in an axial direction, and which is in gaseous communication with the storage volume via the inlet.

17. The circuit breaker as claimed in claim 16, wherein a return duct for the quenching gas is arranged between the pressure chamber and the inlet.

18. The circuit breaker as claimed in claim 11, wherein the storage volume encloses the arcing space in the radial direction.

19. The circuit breaker as claimed in claim 18, wherein the storage volume encloses the arcing space in an at least essentially annular or toroidal form.

20. The circuit breaker as claimed in claim 1, wherein the quenching gas is selected from the group of $SF_6$, $CO_2$, $N_2$, and air, or a mixture of said gases.

21. The circuit breaker as claimed in claim 10, wherein the heat-insulating coating is applied to a surface of the obturator which, in the closed position thereof, faces away from the storage volume, wherein the circuit breaker is a generator circuit breaker, and the contact elements between which an arc is generated during a breaking operation form part of an arcing contact arrangement, and the generator circuit breaker is also provided with rated current contacts.

22. The circuit breaker as claimed in claim 1, wherein the storage volume is enclosed in the radial direction by an external extinction chamber in which the rated current contacts are arranged, and wherein a circumferential third partition of heat-insulating material separates the storage volume from the external extinction chamber.

23. The circuit breaker as claimed in claim 1, wherein the heat-insulating coating is structured to prevent plastic strain of the valve during an arcing event that occurs in the arcing space.

* * * * *